US006622610B2

(12) United States Patent
Adkins

(10) Patent No.: US 6,622,610 B2
(45) Date of Patent: Sep. 23, 2003

(54) GAS RETARDED BLOWBACK OPERATING SYSTEM FOR PISTOLS AND OTHER SHORT BARRELED WEAPONS

(75) Inventor: John Adkins, Marietta, OH (US)

(73) Assignee: KG Industries, Inc., Hawyard, WI (US)

( * ) Notice: Subject to any disclaimer, the term of this patent is extended or adjusted under 35 U.S.C. 154(b) by 0 days.

(21) Appl. No.: 10/098,070

(22) Filed: Mar. 14, 2002

(65) Prior Publication Data

US 2002/0096042 A1 Jul. 25, 2002

Related U.S. Application Data

(63) Continuation of application No. 09/204,986, filed on Dec. 3, 1998, now abandoned.

(51) Int. Cl.[7] ..... F41A 3/90
(52) U.S. Cl. ..... 89/193; 89/43.01
(58) Field of Search ..... 89/191.01, 191.02, 89/193, 43.01

(56) References Cited

U.S. PATENT DOCUMENTS

| | | | | | |
|---|---|---|---|---|---|
| 3,990,346 | A | * | 11/1976 | Irwin | 89/180 |
| 4,909,129 | A | * | 3/1990 | Reynolds | 89/191.01 |
| 4,977,815 | A | * | 12/1990 | Stephens | 89/180 |
| 5,734,120 | A | * | 3/1998 | Besselink | 89/163 |
| 5,834,678 | A | * | 11/1998 | Kalb | 89/191.01 |

FOREIGN PATENT DOCUMENTS

| | | | | |
|---|---|---|---|---|
| CH | 244082 | * | 8/1946 | 89/191.01 |
| FR | 1266597 | * | 6/1961 | 89/191.01 |
| IT | 317095 | * | 4/1934 | 89/191.01 |

OTHER PUBLICATIONS

English translation of Schmeisser (Switzerland 244082)*

* cited by examiner

*Primary Examiner*—Stephen M. Johnson
(74) *Attorney, Agent, or Firm*—Michael Best & Friedrich LLP

(57) ABSTRACT

The closure of a blowback operated weapon is augmented by a gas cylinder and piston. The piston is self centering.

14 Claims, 6 Drawing Sheets

GAS RETARDED BLOWBACK OPERATING SYSTEM FOR PISTOLS AND OTHER SHORT BARRELED WEAPONS

This application is a continuation of U.S. patent application Ser. No. 09/1204,986, filed on Dec. 3, 1998, and now abandoned.

BACKGROUND OF INVENTION

Typical semiautomatic pistols are equipped with moveable barrels which are locked into moveable slides during firing. The required clearances between the interfacing moveable parts and the motion of the parts during firing contributes to reduction in accuracy of the weapon. The required number of parts and the inherently complex machining of the parts of conventional pistols contributes to high cost of finished weapons. The M1911 series of U.S. service pistols and other pistols based upon the Browning operating system is the most common high powered semiautomatic pistol design in the world. The relative motion of the barrel with the frame in these weapons requires careful gunsmithing in order for these pistols to shoot accurately.

SUMMARY OF PRESENT INVENTION

The present invention provides for more accurate fire and for lower cost manufacture for semiautomatic pistols and other short barreled weapons firing high powered cartridges. Unlike typical medium and high powered semiautomatic pistols, the barrel of the present invention is fixed to the frame of the weapon, eliminating movement of the barrel relative to the frame.

The invention can be applied as a modification to existing weapons permitting the owner of an existing weapon to significantly improve the performance of the weapon by replacing the appropriate parts with the present invention.

The present invention eliminates the typical barrel link and link pin from conventional weapons which have been modified with the present invention. When applied to new-manufacture weapons, in addition to eliminating the barrel link and link pin, the machining of locking lugs on the barrel and of the locking recesses in the slide are eliminated.

The present invention utilizes a portion of the gases generated during firing in order to retard the rearward movement of the recoiling parts. Gas is vented through a hole just forward of the chamber into a gas cylinder below, and parallel to the barrel. The barrel and gas cylinder are a unit which is fixed to the frame of the weapon. The gas cylinder is closed at the rear and open at the front. A close fitting piston fits the gas cylinder. The forward end of the piston, through intervening parts, bears against the operating slide. The gas piston is provided with a self centering means which permits the piston to be machined to a close fit with the gas cylinder in spite of possible imperfect alignment of other related parts.

When the weapon is fired, the propellant gases drive the projectile forward and drive the cartridge case and slide rearward. During initial movement of the projectile, and until the projectile base reaches the gas port just forward of the chamber, the weapon operates as a simple blowback weapon. As the base of the projectile passes the gas port, the gas port is exposed to the same high pressure gases which are driving the projectile. Gas is vented through the gas port and into the volume defined by the gas cylinder and gas piston. The gas in the cylinder applies force against the piston which retards rearward movement of the slide.

DESCRIPTION OF THE ILLUSTRATIVE EMBODIMENT

Figure 1:
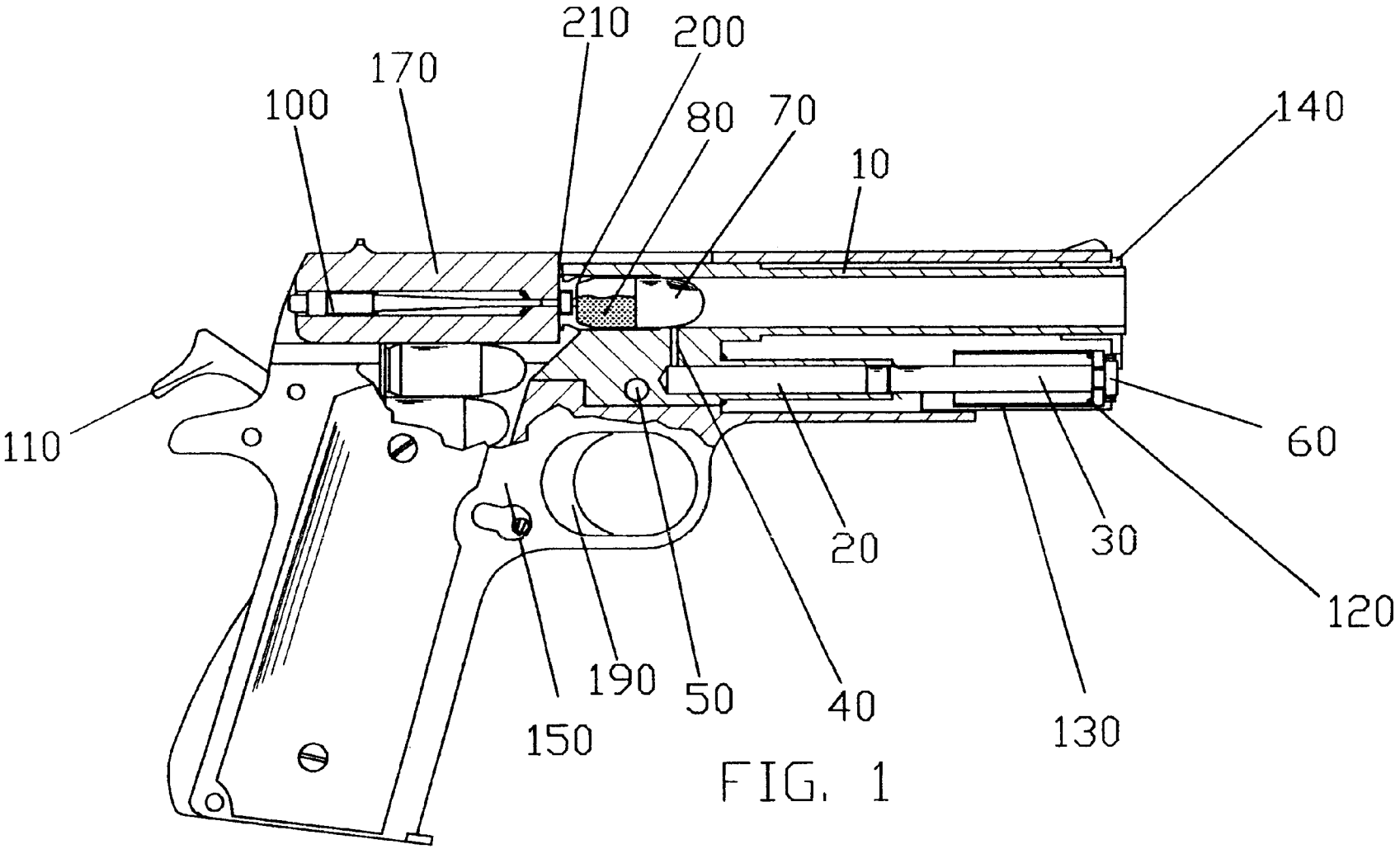
FIG. 1 is a plan view in section of a weapon with the gas retarded blowback operating system ready to fire.
Figure 6:
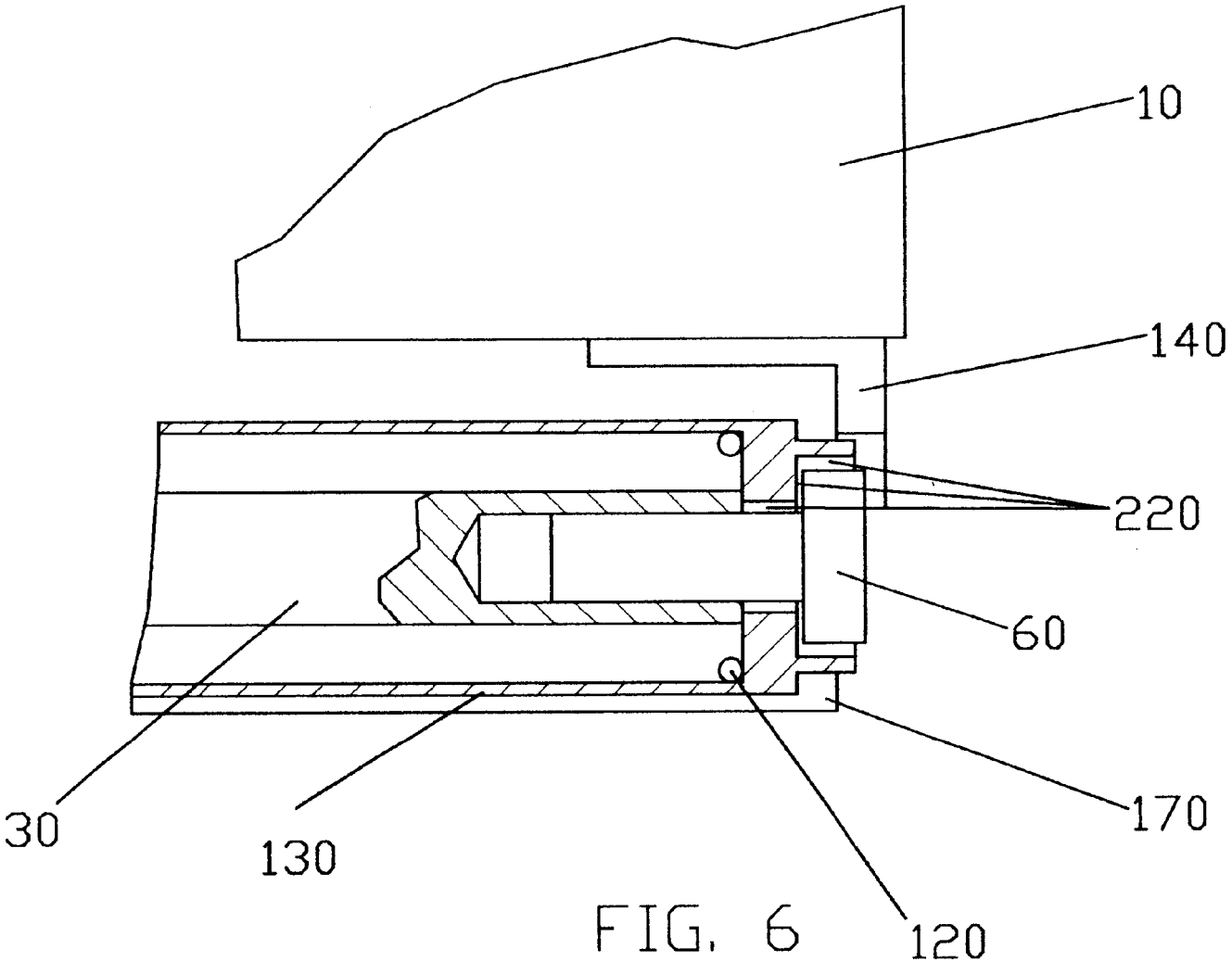
FIG. 6 is a plan view partial section showing details of the self centering gas piston.

Referring to FIG. 1, the weapon provided with the gas retarded operating system-is ready to fire. The hammer 110 is cocked, being held by a sear, not shown. A cartridge case 200 with propellant 80 and projectile 70 is loaded into the chamber of barrel 10. Slide 170 is in its forward position with the barrel bushing 140 centering the muzzle of barrel 10. Barrel 10 is retained to frame 150 by pin 50. Gas cylinder 20 is part of barrel 10. The rear of gas piston 30 is centered in the front of gas cylinder 20. The front of gas piston 30 is located in recoil spring plug 130 by centering screw 60. (More detail of centering screw 60 is shown in FIG. 6) The rear of recoil spring 120 fits around gas cylinder 20 and rests against the lower portion of barrel 10. The front of recoil spring 120 rests against the inside of recoil spring plug 130. Recoil spring plug 130 is retained by barrel bushing 140. Barrel bushing 140 is secured to slide 170. Barrel bushing 140 has a sliding fit with barrel 10. Slide 170 and frame 150 have mating longitudinal guideways which permit the slide 170, with its components, to move longitudinally relative to frame 150 and its components. Recoil spring 120 provides sufficient force to hold slide 170 in its forward or battery position.

Figure 2:
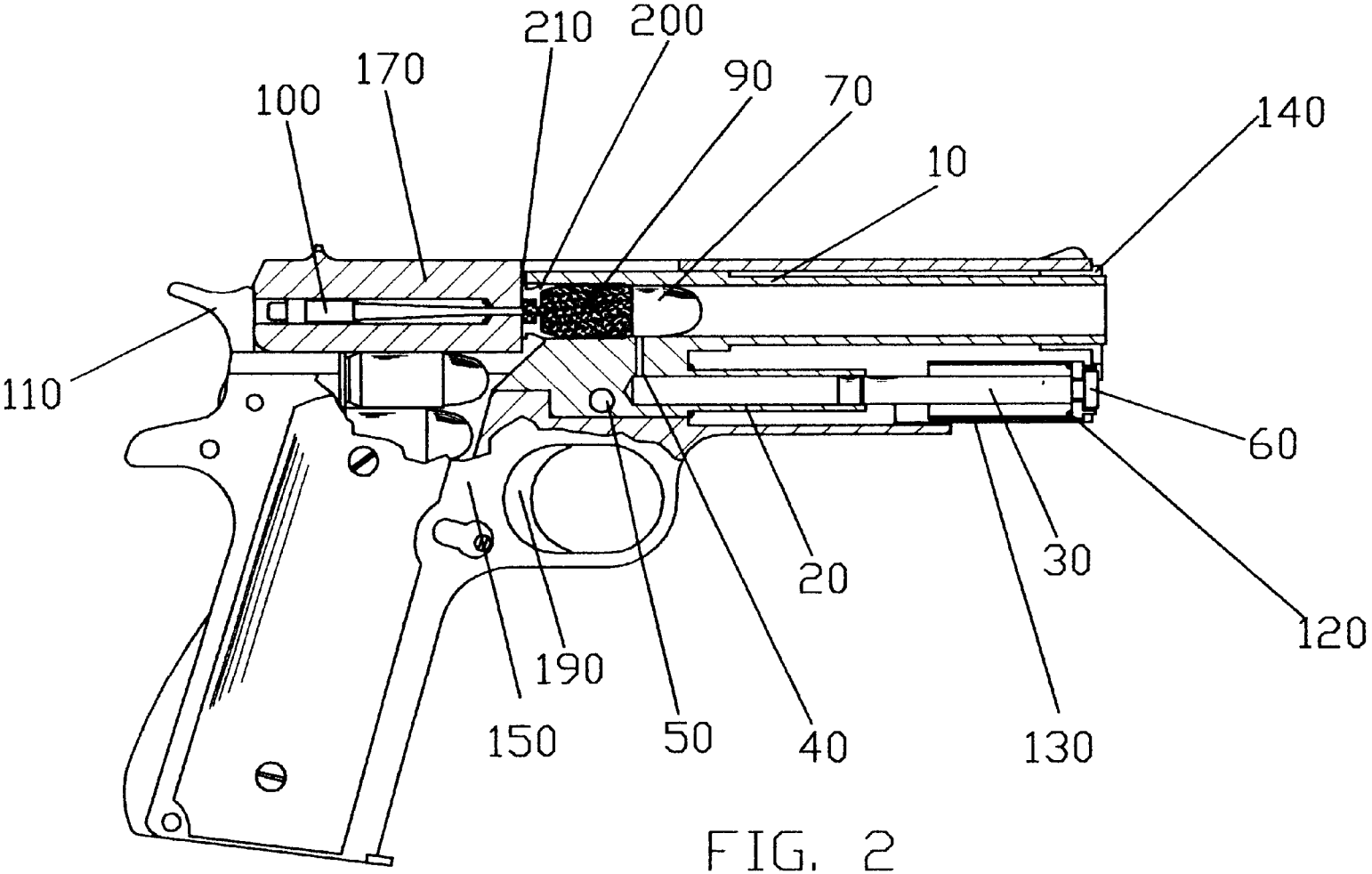
FIG. 2 is a plan view in section of the weapon having fired and the projectile beginning to move.
Figure 3:
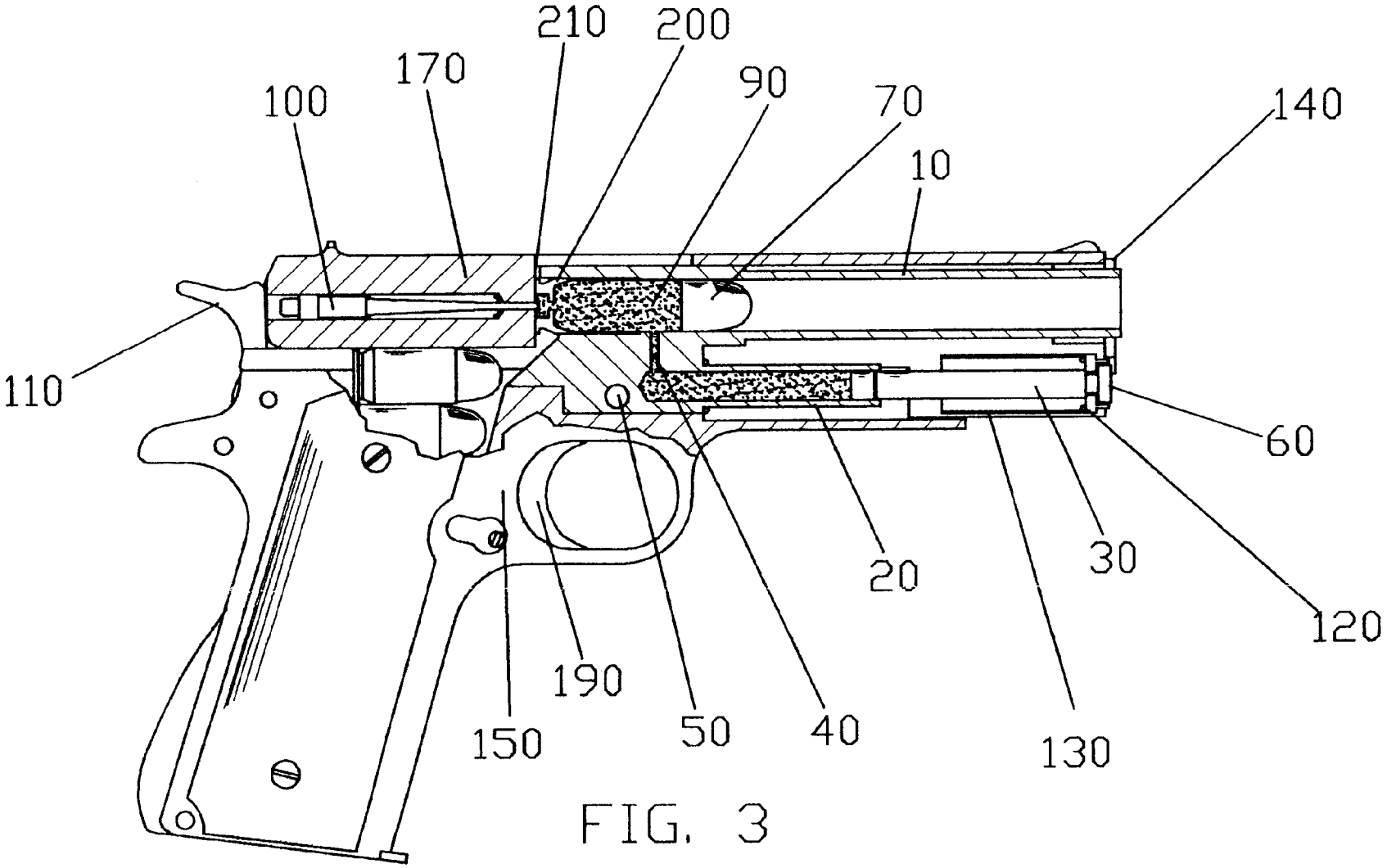
FIG. 3 is a plan view in section of the weapon with the projectile having passed the gas port.

Referring now to FIG. 2, trigger 190 has been pulled to release hammer 110. Hammer 110 has struck firing pin 100. The inertia imparted by hammer 110 to firing pin 100 has carried firing pin 100 rapidly forward causing the tip of firing pin 100 to strike and detonate the primer in cartridge case 200 in the chamber of barrel 10. The detonation of the primer has ignited propellant 80 (as shown in FIG. 1) producing pressurized propellant gas 90 of FIG 2. The highly pressurized propellant gas 90 has begun to drive projectile 70 forward and slide 170 rearward by force applied through the base of cartridge case 200 to breech face 210 of slide 170. If projectile 70 diameter is 0.45 inch and projectile 70 weighs 200 grains, and if the slide 170 weighs 5,740 grains (0.82 lbs), the ratio of the mass of projectile 70 to the mass of slide 170 is approximately 0.0348. Since equal force is being applied in opposite directions to projectile 70 and slide 170 the relative distances moved by the projectile 70 and slide 170 are in a ratio of 0.0348. Therefore while propellant gas 90 drives projectile 70 a distance of 0.25 inch forward (which is the approximate distance to the rear of the gas port 40) slide 170 will be driven approximately $0.25 \times 0.0348 = 0.0087$ inch rearward. The wall of the cartridge case 200 in the chamber of barrel 10 has been pressed tightly against the chamber wall of barrel 10 by pressure from propellant gas 90. This pressure causes the front of the cartridge case 200 to adhere to the chamber. The rear of cartridge case 200 is being driven rearward while the front of cartridge case 200 is remains stationary relative to the chamber of barrel 10 causing elastic stretching, and possibly plastic deformation of cartridge case 200. If the wall of cartridge case 200 were to remain adhered to the chamber of barrel 10 while the base of cartridge case 200 continued rearward, then eventually cartridge case 200 would rupture. But:

Referring now to FIG. 3, projectile 70 has moved past gas port 40 exposing propellant gas 90 to gas port 40. Since propellant gas 90 is a fluid, and of much lower mass than the projectile, and at high pressure, a portion of propellant gas 90 very quickly passes through gas port 40 and into the interior of gas cylinder 20. The front of gas cylinder 20 is plugged by gas piston 30, confining propellant gas 90 within gas cylinder 20. The pressure in gas cylinder 20 rapidly builds up to equal (neglecting friction and turbulence of the gas passing through gas port 40) the pressure behind projectile 70 in barrel 10. Propellant gas 90 in gas cylinder 20 applies force to gas piston 30. Gas piston 30 is retained by recoil spring plug 130, which in turn, is retained by barrel bushing 140. Barrel bushing 140 is affixed to slide 170. Therefore the force of propellant gas 90 in gas cylinder 20, being transmitted through gas piston 30 and barrel bushing 140, resists rearward movement of slide 170, while propellant gas 90 in barrel 10 continues driving projectile 70 forward and driving slide 170 rearward. If the diameter of projectile 10 is 0.45 inch and the diameter of gas piston 30 is 0.25 inch, the ratio of the area of the gas piston to the area of the projectile is approximately 0.308. Therefore the rearward movement of slide 170 is resisted through piston 30 by pressure in gas cylinder 20 equal to 0.308 times the force which is driving projectile 70 forward and slide 170 rearward. This retardation is sufficient to prevent the slide 170 from moving far enough rearward to result in rupture of cartridge case 200 while high gas pressure remains in barrel 10. The system is designed to use normal cartridge cases (that is, not requiring extra strength cartridge cases) without damage to the cartridge cases.

If the pressure in pressurized gas 90 is 20,000 psi and the basal area of projectile 70 is 0.159 square inch, then the force on breech face 210 is 3,180 lbs. If the force provided by recoil spring 120 is say, 8 lbs and the force of the hammer spring is also 8 pounds, then the total force from spring resistance is 16 lbs which is approximately 0.005 or ½% of the total reaction force of projectile 70 driving slide 170 rearward. The mass of slide 170 with its component parts, along with the mass of the hammer 110, therefore provides most of the resistance to rearward movement of slide 170. Resistance to rearward movement of slide 170 is augmented by the pressure of propellant gas 90 against piston 30 within gas cylinder 20.

If the actual pressure in gas cylinder 20 is say 15,000 psi (compared to 20,000 psi in barrel 10) and the area of the piston is 0.040 square inch, then the resistance to piston 30 is 736 lbs or 23% of the 3,180 lb reaction force of the projectile driving slide 170 rearward.

Figure 4:
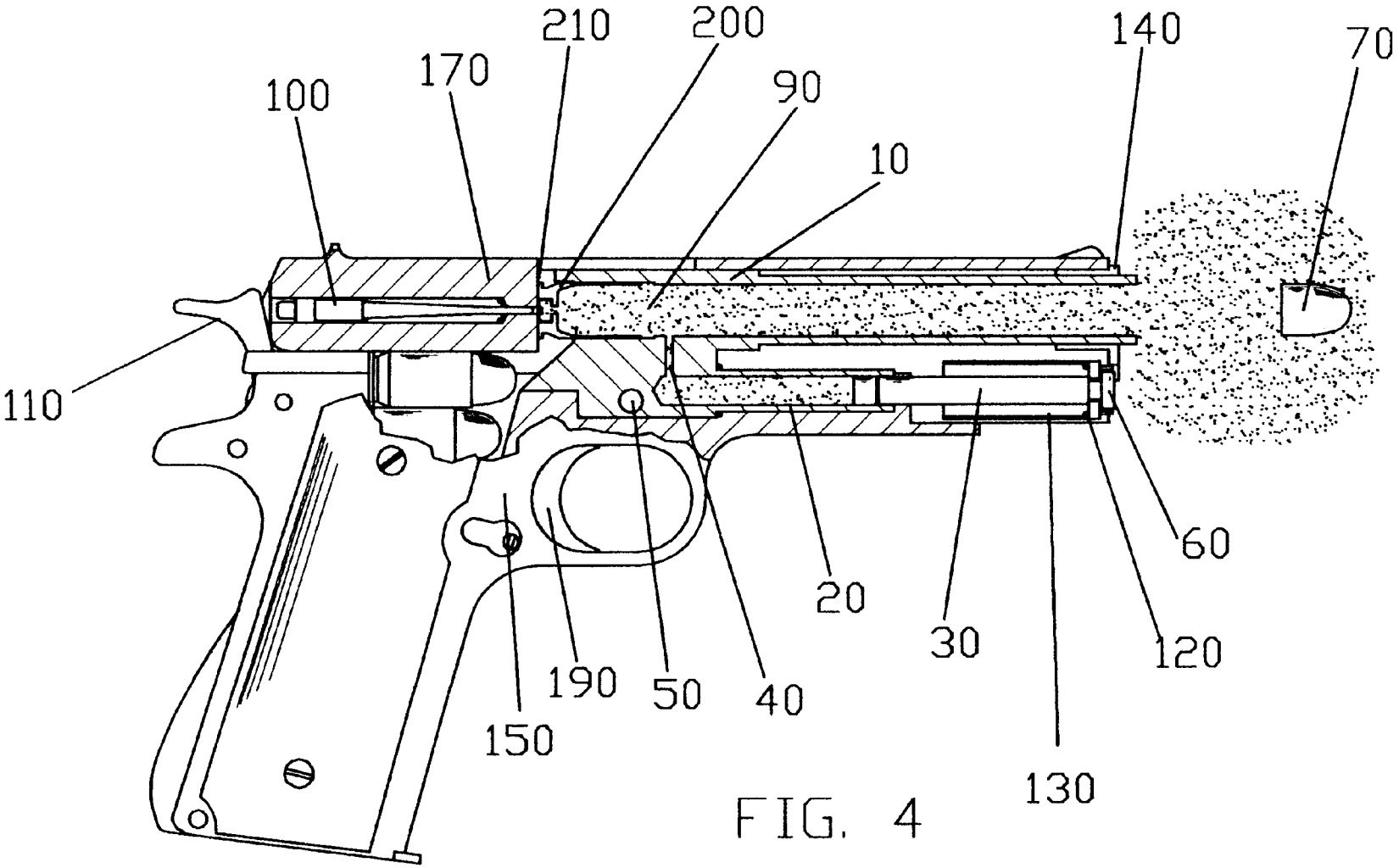
FIG. 4 is a plan view in section of the weapon with the projectile having exited the muzzle.

Referring now to FIG. 4 in which projectile 70 has exited the muzzle of barrel 10, releasing pressurized gas 90 from barrel 10 into the atmosphere. Pressurized gas 90 in gas cylinder 20 now vents back into barrel 10 and out the muzzle of the barrel 10. The residual of pressurized gas 90 in gas cylinder 20 acts as a buffer for the rearwardly moving gas piston 30. Slide 170 continues to move rearward of its own momentum compressing recoil spring 120.

Figure 5:
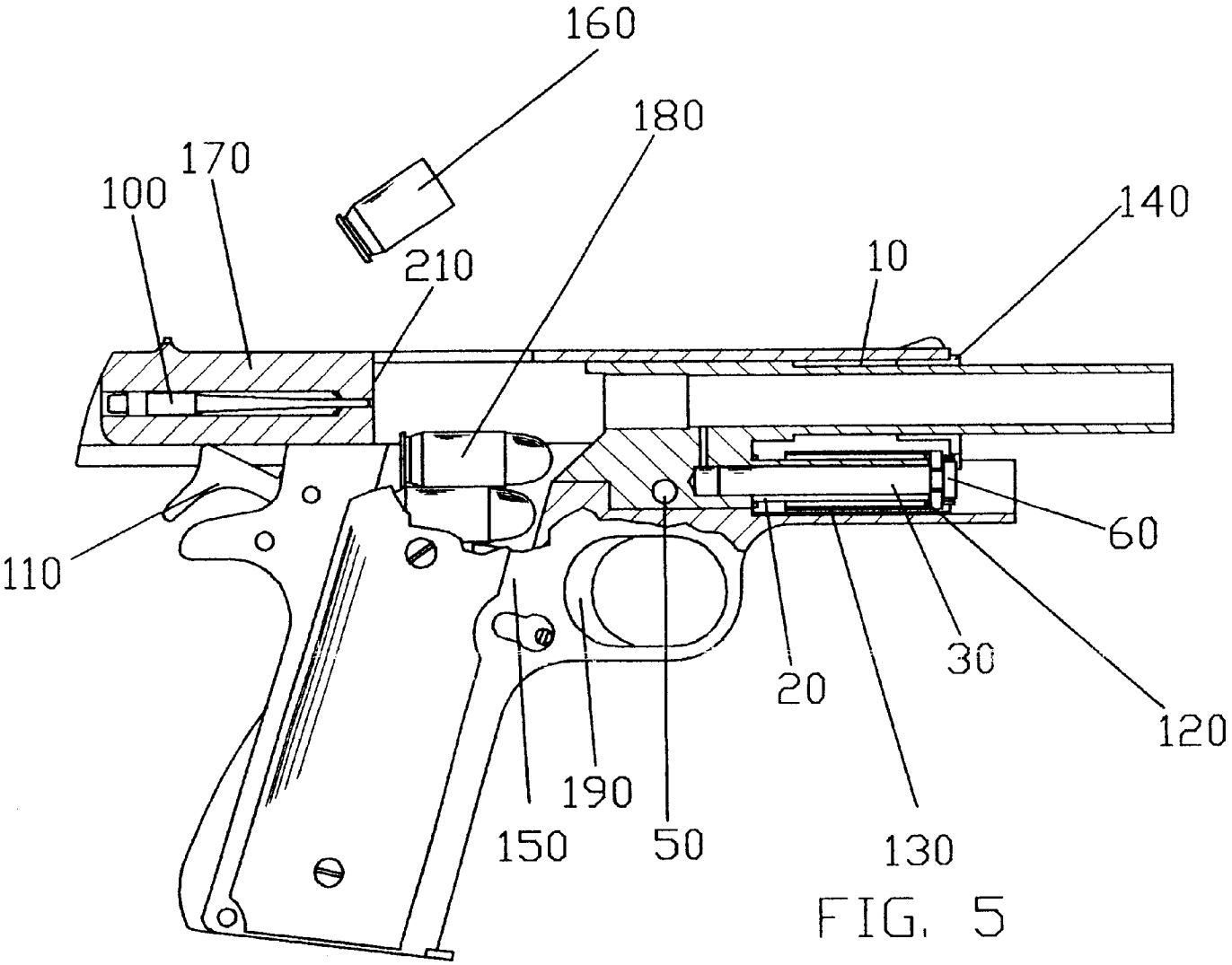
FIG. 5 is a plan view in section of the weapon with the operating slide in full recoil.

Referring now to FIG. 5 in which gas pressure in the system has dropped to atmospheric. Spent cartridge case 160 has been ejected from the weapon. Slide 170 has moved far enough to the rear to permit fresh cartridge 180 to rise into the path of the exposed breech face 210 of slide 170. Slide 170 has rotated hammer 110 beyond the cocked position, compressing the hammer spring, not shown, in preparation for the next shot. Recoil spring 120 has been compressed, and after slide 170 has been completely arrested in its rearward movement, recoil spring 120 will drive slide 170 forward chambering fresh cartridge 180. When slide 170 has moved to its battery position, and after the trigger released to reset the firing mechanism, the weapon will be ready for firing the next shot.

Referring now to FIG. 6 which shows details of the function of centering screw 60. Spaces 220 between centering screw 60 and recoil spring plug 130 permit centering screw 60 to move laterally in the event of imperfect alignment of gas piston 30 with recoil spring plug 130 and barrel bushing 140.

The foregoing disclosure and drawings are merely illustrative of the principles of this invention and are not to be interpreted in a limiting sense. We wish it to be understood that we do not desire to be limited to the exact details of instruction shown and described because obvious modifications will occur to a person skilled in the art.

What we claim is:

1. A breech loading firearm, comprising:

a frame;

a breech slide, movably coupled to the frame;

a barrel coupled to the frame;

a gas buffer adjacent the barrel, the gas buffer including a piston movable within a cylinder, the piston coupled to the breech slide and the cylinder coupled to the frame, wherein the piston is movably coupled to the breech slide with a means permitting lateral movement of the piston relative to the breech slide; and a gas port between the barrel and the gas buffer, whereby upon firing the firearm, pressure from the barrel will enter the gas buffer and inhibit the rearward movement of the breech slide.

2. The firearm of claim 1, wherein the gas buffer is substantially parallel to the barrel.

3. The firearm of claim 1 wherein the gas buffer includes two end walls, the end walls being movable with respect to each other.

4. The firearm of claim 3, wherein the firearm is designed to shoot a projectile out of a front of the firearm, and wherein the end wall closest to the front is coupled to the breech slide and the end wall furthest from the front is coupled to the frame.

5. The firearm of claim 1, further comprising a recoil spring coupled to the breech slide, the recoil spring biasing the breech slide relative to the frame.

6. The firearm of claim 5, wherein the recoil spring surrounds the gas buffer.

7. The firearm of claim 1, wherein the barrel is fixedly coupled to the frame.

8. A breech loading firearm, comprising:

a frame;

a breech slide, movably coupled to the frame;

a barrel coupled to the frame;

a gas buffer adjacent the barrel;

a recoil spring coupled to the breech slide surrounding the gas buffer, the recoil spring biasing the breech slide relative to the frame; and a gas port between the barrel and the gas buffer, whereby upon firing the firearm, pressure from the barrel will enter the gas buffer and inhibit the rearward movement of the breech slide.

9. The firearm of claim 8, wherein the gas buffer is substantially parallel to the barrel.

10. The firearm of claim 8, wherein the gas buffer includes two end walls, the end walls being movable with respect to each other.

11. The firearm of claim 10, wherein the firearm is designed to shoot a projectile out of a front of the firearm, and wherein the end wall closest to the front is coupled to the breech slide and the end wall furthest from the front is coupled to the frame.

12. The firearm of claim 8, wherein the gas buffer includes a piston movable within a cylinder, the piston coupled to the breech slide and the cylinder coupled to the frame.

13. The firearm of claim 12, wherein the piston is movably coupled to the breech slide with a means permitting lateral movement of the piston relative to the breech slide.

14. The firearm of claim 8, wherein the barrel is fixedly coupled to the frame.

* * * * *

UNITED STATES PATENT AND TRADEMARK OFFICE

CERTIFICATE OF CORRECTION

PATENT NO. : 6,622,610 B2
DATED : September 23, 2003
INVENTOR(S) : John Adkins

It is certified that error appears in the above-identified patent and that said Letters Patent is hereby corrected as shown below:

Column 1,
Line 5, delete "09/1204,986," and insert -- 09/204,986 --.

Signed and Sealed this

Twentieth Day of January, 2004

JON W. DUDAS
*Acting Director of the United States Patent and Trademark Office*